US011149934B2

(12) United States Patent
Chen et al.

(10) Patent No.: US 11,149,934 B2
(45) **Date of Patent: *Oct. 19, 2021**

(54) LED LIGHT APPARATUS

(71) Applicant: XIAMEN ECO LIGHTING CO. LTD., Xiamen (CN)

(72) Inventors: Xiaobo Chen, Xiamen (CN); Yongzhe Dong, Xiamen (CN); Zongjin Liu, Xiamen (CN); Maojin Zeng, Xiamen (CN); Daqiang Li, Xiamen (CN); Yongchuan Li, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/735,433

(22) Filed: Jan. 6, 2020

(65) Prior Publication Data

US 2020/0141566 A1 May 7, 2020

Related U.S. Application Data

(63) Continuation of application No. 16/042,427, filed on Jul. 23, 2018, now Pat. No. 10,557,624, which is a (Continued)

(30) Foreign Application Priority Data

Aug. 10, 2015 (CN) ..... 201510483673.1

(51) Int. Cl.
*H01R 13/18* (2006.01)
*F21V 23/06* (2006.01)
(Continued)

(52) U.S. Cl.
CPC ..... *F21V 23/06* (2013.01); *F21K 9/238* (2016.08); *F21V 23/006* (2013.01); (Continued)

(58) Field of Classification Search
CPC ..... H01R 12/52; H01R 13/24; H01R 13/641; H01R 43/02; H01R 4/00
See application file for complete search history.

(56) References Cited

U.S. PATENT DOCUMENTS 8,142,227 B1 * 3/2012 Kuo ..... H01J 5/62 439/611
8,591,062 B2 * 11/2013 Hussell ..... F21V 23/06 362/249.01

(Continued)

*Primary Examiner* — Truc T Nguyen
(74) *Attorney, Agent, or Firm* — Chun-Ming Shih; Lanway IPR Services

(57) ABSTRACT

A LED light apparatus includes an electrical connector device for electrically connecting a light source board and a driver board. The electrical connector device comprising an input terminal and an output terminal, one end of input terminal is fixed on the driver board of the LED light and electrically connected to the driver board. The output terminal includes a conductive terminal, an elastic clipping portion, and a resistance portion, the conductive terminal includes a conductive pin, the conductive pin is fixed on the light source board and electrically connected to the light source board, the elastic clipping portion and the resistance portion are placed on the conductive terminal, and when assembled, the other end of the input terminal elastically touches one end of the elastic resistance portion and the resistance portion touches the other end of the resistance portion. The electrical connector of LED light owns the advantages of simple structure and high reliability.

13 Claims, 4 Drawing Sheets

Related U.S. Application Data continuation of application No. 15/508,456, filed as application No. PCT/CN2016/090152 on Jul. 15, 2016, now Pat. No. 10,060,612.

(51) Int. Cl.

| | |
|---|---|
| ***H01R 12/71*** | (2011.01) |
| ***F21K 9/238*** | (2016.01) |
| ***F21V 23/00*** | (2015.01) |
| ***H01R 12/72*** | (2011.01) |
| ***H01R 13/14*** | (2006.01) |
| *H01R 12/57* | (2011.01) |
| *H01R 12/73* | (2011.01) |
| *H01R 13/11* | (2006.01) |
| *F21Y 115/10* | (2016.01) |

(52) U.S. Cl.

CPC ..... *H01R 12/716* (2013.01); *H01R 12/718* (2013.01); *H01R 12/722* (2013.01); *H01R 13/14* (2013.01); *H01R 13/18* (2013.01); *F21Y 2115/10* (2016.08); *H01R 12/57* (2013.01); *H01R 12/728* (2013.01); *H01R 12/737* (2013.01); *H01R 13/113* (2013.01)

(56) References Cited

U.S. PATENT DOCUMENTS

| | | | | |
|---|---|---|---|---|
| 8,752,983 | B2 * | 6/2014 | Hussell | F21V 29/85 362/249.02 |
| 9,933,148 | B2 * | 4/2018 | Brandes | F21K 9/90 |
| 9,951,909 | B2 * | 4/2018 | Progl | F21K 9/232 |
| 9,995,438 | B2 * | 6/2018 | Haenen | F21V 29/75 |
| 10,186,793 | B2 * | 1/2019 | Chen | F21V 23/06 |
| 2003/0214810 | A1 * | 11/2003 | Zhang | F21V 29/773 362/294 |
| 2011/0116275 | A1 * | 5/2011 | Sheek | F21V 13/04 362/382 |
| 2012/0224374 | A1 * | 9/2012 | Aliberti | F21K 9/232 362/249.02 |
| 2012/0326623 | A1 * | 12/2012 | Fatt | H01R 13/7175 315/291 |
| 2013/0323938 | A1 * | 12/2013 | Tremblay | H01R 33/09 439/11 |
| 2015/0056834 | A1 * | 2/2015 | Sanders | H01R 33/97 439/232 |
| 2019/0195482 | A1 * | 6/2019 | Chen | F21V 23/005 |
| 2020/0166204 | A1 * | 5/2020 | Zeng | F21V 23/003 |
| 2020/0340651 | A1 * | 10/2020 | Huang | F21V 23/04 |

* cited by examiner

LED LIGHT APPARATUS

TECHNICAL FIELD

The present invention is related to an electrical connector device and more particularly related to an electrical connector device that may be used for a LED light.

BACKGROUND

With the rising of the global environmental awareness, a LED light has developed rapidly in the lightning field. General LED light usually includes a light source board and a driver board, and the driver board needs to be electrically connected with the light source board to realize the purpose of driving the LED light. So far, using a lead welded to make electrically connect between the light source board and the driver to achieve the purpose of connecting driver electricity. The connecting way is not conducive for automated production. It needs artificial threading and welding lead. It complexes the production process, lowers the production efficiency, wastes the time and is not good at positioning and installing. Therefore, it has the plan to improve a terminal in automated production nowadays, but these terminals are easy to deform with the long term usage. This makes the fail of electronic connection and the bad reliability.

SUMMARY OF INVENTION

In view of this, it is necessary to provide the electrical connector device of the LED light with a simple structure and a high reliability.

The technical solution for the present invention is an electrical connector device that connects a light source board and a driver board of an LED light electrically. The electrical connector device includes an input terminal and an output terminal, one end of input terminal is fixed on the driver board of the LED light and connected to the driver board electrically. The output terminal includes a conductive terminal, an elastic clipping portion, and a resistance portion, the conductive terminal comprises a conductive pin, the conductive pin is fixed on the light source board and electrically connected to the light source board, the elastic clipping portion and the resistance portion are placed on the conductive terminal, and when assembled, the other end of the input terminal elastically touches one end of the elastic resistance portion and the resistance portion touches the other end of the resistance portion.

Comparing with the existed technology, this electrical connector of LED light includes an input terminal and an output terminal. The driver board, the input terminal, the output terminal and the light source board connect one by one. The output terminal specially sets an elastic clipping portion, and a resistance portion and when assembled, the other end of the input terminal elastically touches one end of the elastic resistance portion and the resistance portion touches the other end of the resistance portion. By this way, the resistance portion may provide the counterforce for the elastic clipping portion to make the elastic clipping portion become tighter and difficult to move. Furthermore, the electrical connector of LED light owns the advantages of simple structure and high reliability.

DETAILED DESCRIPTION

Though the embodiment to describe the present invention detailed in following statement.

Figure 1:
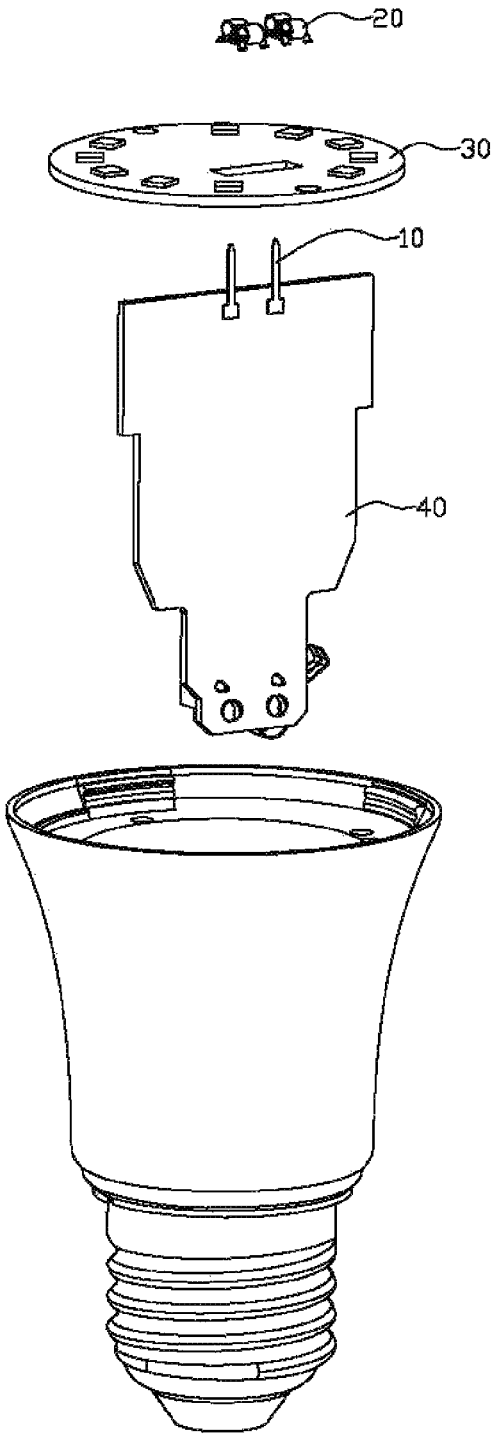
FIG. 1 is the first embodiment stereoscopic decomposition drawing for the present invention, the electronic connector of LED light.

FIG. 1 is the first embodiment stereoscopic decomposition drawing for the present invention, an electronic connector of an LED light. The electrical connector device connects a light source board (30) and a driver board (40) of an LED light electrically. The electrical connector device includes an input terminal (10) and an output terminal (20), one end of input terminal (10) is fixed on the driver board (40) of the LED light and electrically connected to the driver board (40).

Figure 3:
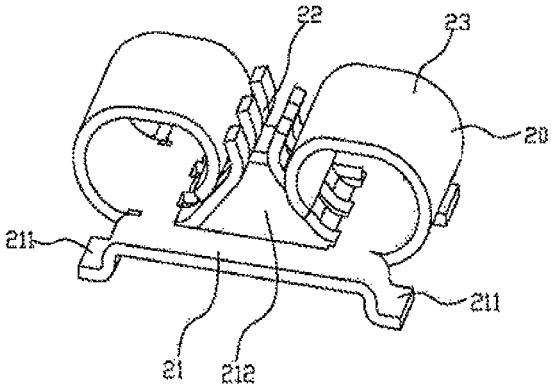
FIG. 3 is the stereoscopic drawing from FIG. 1 that illustrates the output terminal for the electronic connector of LED light.

Based on FIG. 3, the output terminal (20) includes a conductive terminal (21), an elastic clipping portion (22), and a resistance portion (23). The elastic clipping portion (22) and the resistance portion (23) are placed on the conductive terminal (21), in this implementation, the elastic clipping portion (22) and the resistance portion (23) are placed together on the conductive terminal (21) and the conductive terminal (21) is made of metal.

Figure 2:
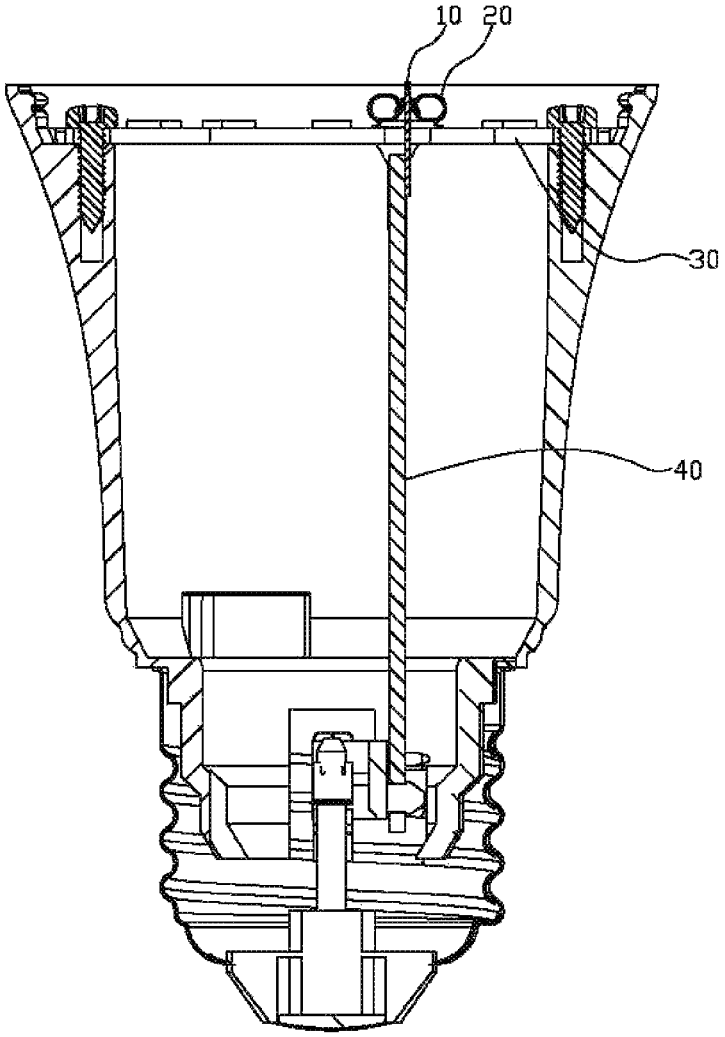
FIG. 2 is the sectional drawing from FIG. 1 that illustrates the combination for the electronic connector of LED light.
Figure 4:
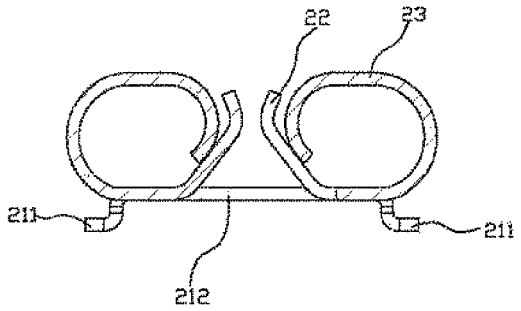
FIG. 4 is the sectional drawing from FIG. 2 that illustrates the output terminal.

Based on FIG. 2 to FIG. 4, the conductive terminal (21) includes a conductive pin (211), usually the conductive terminal (21) through the conductive pin (211) is fixed on the light source board (30) and electrically connected to the light source board (30).

The bottom of the elastic clipping portion (22) is connected to the conductive terminal (21), and the top of the elastic clipping portion (22) is bent with a tilt angle toward the direction away from the conductive terminal (21). In our embodiment, the electrical connector includes two elastic clipping portions (22), the two elastic clipping portions are disposed face to face and form a China character, '八', structure, and the elastic clipping portions separately elastically touch two side walls of the input terminal (10). The conductive terminal (21) has a through hole (212), the elastic clipping portions (22) are symmetrically disposed at two sides of the through hole (212), the input terminal (10) is through the through hole (212) and electrically connected to the elastic clipping portions (22).

In this embodiment, the resistance portion (23) is a '⌈⌉' shape bending structure, the resistance portion (23) is fixed on the conductive terminal (21), and the other end of the resistance portion (23) touches the elastic clipping portion (22). There is an opening in each elastic clipping portion (22) so that each elastic clipping portion (22) forms a comb structure. These elastic clipping portions'(22) comb structures with cross set so that rise the elastic clipping portion's (22) flexibility in one hand. On the other hand, the comb structure make the input terminal connect with the elastic clipping portion (22) own much electricity to touch and enhance the possibility of electronic connection.

When assembled, the other end of the input terminal (10) elastically touches one end of the elastic resistance portion (22) and the resistance portion (23) touches the other end of the resistance portion. In our embodiment, the other end of the input terminal (10) elastically touches the top of the elastic clipping portion (22), and the resistance portion (23) touches the middle of the elastic clipping portion (22).

Therefore, the input terminal (10) separates from the resistance portion (23) may effectively limit the deform range of the elastic 105 clipping portion (22). In conclusion, this electrical connector of LED light includes an input terminal (10) and an output terminal (20). The driver board (40), the input terminal (10), the output terminal (20) and the light source board (30) connect one by one. The output terminal specially sets an elastic clipping portion (22), and a resistance portion (23) and when assembled, the other end of the input terminal (10) elastically touches one end of the elastic resistance portion (22) and the resistance portion (23) touches the other end of the resistance portion (23). By this way, the resistance portion (23) may provide the counterforce for the elastic clipping portion (22) to make the elastic clipping portion (22) become tighter and difficult to move when connected to the input terminal (10). Furthermore, the electrical connector of LED light owns the advantages of simple structure and high reliability.

Certainly, the resistance portion is capable of a rigid structure, one end of the resistance portion (23) is fixed on the conductive terminal (21), and the other end of the resistance portion (23) touches the middle of the elastic clipping portion (22). By this way, it may have the same effect on limiting the deform of the elastic clipping portion (22).

The statement above just for the better embodiment, not for limiting the present invention. All the modification, equal to any change and improvement that are based on the present invention's spirit and principle, may be protected in the present invention protection range.

The invention claimed is:

1. A LED light apparatus, comprising:

a driver board;

a light source board; and an electrical connector device for electrically connecting a light source board and a driver board of an LED light, the electrical connector device comprising an input terminal and an output terminal, wherein one end of input terminal is fixed on the driver board of the LED light and electrically connected to the driver board, the output terminal comprises a conductive terminal, an elastic clipping portion, and a resistance portion, the conductive terminal comprises a conductive pin, the conductive pin is fixed on the light source board and electrically connected to the light source board, the elastic clipping portion and the resistance portion are placed on the conductive terminal, and when assembled, the other end of the input terminal elastically touches one end of the elastic resistance portion and the resistance portion touches the other end of the elastic clipping portion, and the other end of the input terminal elastically touches a top of the elastic clipping portion, and the resistance portion touches a middle of the elastic clipping portion, and wherein the resistance portion is a rigid structure, one end of the resistance portion is fixed on the conductive terminal, and the other end of the resistance portion touches the middle of the elastic clipping portion.

2. The LED light apparatus of claim 1 wherein the resistance portion is an elastic clip structure, one end of the resistance portion is fixed on the conductive terminal, and the other end of the resistance portion is bent and then touches elastic clipping portion.

3. The LED light apparatus of claim 2, wherein the resistance portion is a 'door' shape bending structure, and the other end of the resistance portion touches the elastic clipping portion.

4. The LED light apparatus of claim 1, wherein multiple LED components are disposed in peripheral side of the light source board.

5. The LED light apparatus of claim 1, wherein the bottom of the elastic clipping portion is connected to the conductive terminal, and the top of the elastic clipping portion is bent with a tilt angle toward the direction away from the conductive terminal.

6. The LED light apparatus of claim 1, wherein the other end of the input terminal elastically touches the top of the elastic clipping portion, and the resistance portion touches the middle of the elastic clipping portion.

7. The LED light apparatus of claim 1, wherein the resistance portion is a rigid structure, one end of the resistance portion is fixed on the conductive terminal, and the other end of the resistance portion touches the middle of the elastic clipping portion.

8. The LED light apparatus of claim 1, characterized in that: the resistance portion is an elastic clip structure, one end of the resistance portion is fixed on the conductive terminal, and the other end of the resistance portion is bent and then touches elastic clipping portion.

9. The LED light apparatus of claim 8, wherein the resistance portion is a 'door' shape bending structure, and the other end of the resistance portion touches the elastic clipping portion.

10. The LED light apparatus of claim 1, wherein the electrical connector comprises two elastic clipping portions, the two elastic clipping portions are disposed face to face, and the elastic clipping portions separately elastically touch two side walls of the input terminal.

11. The LED light apparatus of claim 10, wherein the conductive terminal has a through hole, the elastic clipping portions are symmetrically disposed at two sides of the through hole, the input terminal is through the through hole and electrically connected to the elastic clipping portions.

12. The LED light apparatus of claim 10, wherein there is an opening in each elastic clipping portion so that each elastic clipping portion forms a comb structure.

13. The LED light apparatus of claim 1, wherein the driver board is fixed to a cap housing of the LED light apparatus.

* * * * *